US006905329B2

(12) United States Patent
Wong

(10) Patent No.: US 6,905,329 B2
(45) **Date of Patent: *Jun. 14, 2005**

(54) TORCH LIGHTER FOR CIGAR

(76) Inventor: Chi Lam Wong, 215 Lee Ave., South El. Monte, CA (US) 91544

( * ) Notice: Subject to any disclaimer, the term of this patent is extended or adjusted under 35 U.S.C. 154(b) by 118 days.

This patent is subject to a terminal disclaimer.

(21) Appl. No.: 10/658,662

(22) Filed: Sep. 8, 2003

(65) Prior Publication Data

US 2004/0048214 A1 Mar. 11, 2004

Related U.S. Application Data

(62) Division of application No. 10/079,990, filed on Feb. 19, 2002.

(51) Int. Cl.[7] ..... F23D 14/04; F23D 14/62; F23Q 7/12

(52) U.S. Cl. ..... 431/255; 431/285; 431/344; 431/354; 431/266; 431/349

(58) Field of Search ..... 431/344, 349, 431/354, 350, 286, 266, 255, 355, 278, 283, 285; 239/565, 543, 548, 552

(56) References Cited

U.S. PATENT DOCUMENTS

| | | | | |
|---|---|---|---|---|
| 2,267,063 A | * | 12/1941 | Westbrook, Jr. | 431/349 |
| 2,547,276 A | * | 4/1951 | Marsh et al. | 431/207 |
| 4,639,214 A | * | 1/1987 | Ainoz | 431/344 |
| 5,711,662 A | * | 1/1998 | Ishiguro | 431/344 |
| 6,171,544 B1 | * | 1/2001 | Anderson et al. | 266/47 |
| 6,558,156 B2 | * | 5/2003 | Wong | 431/266 |

FOREIGN PATENT DOCUMENTS

| | | | |
|---|---|---|---|
| FR | 2 035 563 | * | 7/1970 |
| FR | 2374590 | * | 7/1978 |
| JP | 08-166129 | * | 6/1996 |
| SU | 1020702 | * | 5/1983 |

* cited by examiner

*Primary Examiner*—Carl D. Price
(74) *Attorney, Agent, or Firm*—Raymond Y. Chan; David and Raymond Patent Group

(57) ABSTRACT

A torch lighter includes a fuel nozzle assembly provided for vaporizing the fuel released therefrom to a high-pressured gaseous fuel to emit to the ignition chamber, wherein the vaporizer assembly includes a torch head, which is provided at an emitting end of a nozzle body and supported within a combustion housing, having a root chamber having a size larger than the size of the emitting end of the nozzle body to form a gas stabilizing reservoir to ensure a collective and stable flow of the mixture gas, and two or more elongated nozzle ducts each having an ignition end and a root end extended to a ceiling of the root chamber, wherein a mixture gas ejected from the two ignition ends is ignited in the ignition chamber to form two torches soaring away from the two ignition ends of the two nozzle ducts. A torch stabilizing arrangement is adapted to prevent the strong soaring torches from directly bursting into the air by providing a plurality of root flames which are united and mixed with a root portion of the soaring torches to form a stable environment root flame so as to hold the torches from being burst away by the escaping high-pressured fuel and thus gather to form a strong and stable group of torches.

20 Claims, 8 Drawing Sheets

TORCH LIGHTER FOR CIGAR

CROSS REFERENCE OF RELATED APPLICATION

This is a divisional application of a non-provisional application, application Ser. No. 10/079,990, filed Feb. 19, 2002.

BACKGROUND OF THE PRESENT INVENTION

1. Field of Invention

The present invention relates to lighters, and more particularly to a torch lighter for cigar which is constructed to produce two or more strong diverging torches via a single fuel supplying source, wherein a torch stabilizing and firming technology is employed in the torch nozzle head to virtually produce a strong and stable gathering group of soaring torches, that is especially good at igniting cigars.

2. Description of Related Arts

A lighter is a common tool that replaces matches for igniting cigarettes and cigars. Generally, there are two types of lighter, namely the regular lighter that produces flat flame and the torch lighter that produces torch.

There are various types of regular lighter, including the disposable lighters as disclosed in the U.S. Pat. Nos. 5,547,370 and 5,096,414, the flat flame lighter as suggested in the U.S. Pat. No. 5,711,662, and the piezoelectric lighter as disclosed in U.S. Pat. Nos. 4,786,248 and 6,267,582. Such regular lighter is capable of generating a flat flame which is merely a single tongue of flame. Due to the soft and weak nature of the flat flame, most of such flat flame lighters are good at igniting cigarettes but find difficulty when igniting a cigar.

Since the cigar has a bigger diameter and the cigar tobacco is dryer and harder, the torch lighter that can produce a stronger and hotter torch is generally used to ignite the cigars. U.S. Pat. No. 3,850,571 discloses a typical torch lighter that is structured to generate a single torch. Although the torch is stronger and hotter than the flat flame, its ignition area is relatively small and limited.

In order to increase the igniting area of the torch lighter, how to produce two or more torches simultaneously will be an effective solution. Since it is too costly and not practical to provide two or more torch nozzles and fuel valve assemblies in the limited interior space of the housing of the torch lighter, it is not available in market.

Japanese patent JP10-238773 suggests an alterative structure improved from the burner structure such as U.S. Pat. No. 1,884,764 to provide a flame nozzle having two or more holes to generate more than one tongues of flame. However, such multiple tongues of flame will immediate mix to form a bigger tongue of mix flame that may be larger in size than the flat flame. Such mix flame is still too soft and weak that fails to generate heat as hot as the torch does, especially at the tip portion of the flame, i.e. the main portion of the flat flame for ignition.

SUMMARY OF THE PRESENT INVENTION

A main objective of the present invention is to provide a torch lighter that is constructed to produce two or more strong diverging torches via a single fuel supplying source, wherein a torch stabilizing and firming technology is employed in the torch nozzle head to virtually produce a strong and stable gathering group of soaring torches, that is especially good at igniting cigars.

Another objective of the present invention is to provide a torch lighter that can produce a group of diverging torches for providing more heat at higher temperature that makes the ignition operation prompt and easy.

Another objective of the present invention is to provide a torch lighter that is windproof by producing two or more strong and stable soaring torches.

Another objective of the present invention is to provide a torch lighter which employs a torch stabilizing and firming arrangement to prevent the strong soaring torches from directly bursting into the air by providing a plurality of root flames which are united and mixed with a root portion of the soaring torches to form a stable environment root flame so as to hold the torches from being burst away by the escaping high-pressured fuel and thus gather to form a strong and stable group of torches.

Another objective of the present invention is to provide a torch lighter which virtually produces two or more flows of fuel to generate two or more torches by providing a diversion joint edge between adjacent roots of every two elongated nozzle ducts.

In order to accomplish the above objectives, the present invention provides a torch lighter, comprising:

a casing having a liquefied fuel storage and a fuel valve which is actuated by a fuel lever pivotally mounted in the casing for releasing fuel therefrom;

an ignition unit generating sparks directed toward an ignition chamber; and a fuel nozzle assembly provided for vaporizing the fuel released therefrom to a high-pressured gaseous fuel to emit to the ignition chamber, wherein the vaporizer assembly comprises:

a tubular nozzle body having a root opening at one end thereof, an emitting opening at another end thereof, at least an air inlet provided adjacent to the root opening, and an elongated mixing chamber axially extended between the air inlet to the emitting opening thereof, wherein a flow of air is capable of inletting into the mixing chamber through the air inlet;

a torch nozzle, which is coaxially connected between the root end of the nozzle body and the fuel valve, having a micro nozzle pore having a diameter as small as 0.05 mm to 0.12 mm, wherein the fuel released from the fuel valve is vaporized into a strong, pressurized gaseous fuel jetting into the mix chamber, wherein the jetting gaseous fuel provides a suction force to absorb the air into the mix chamber in such a manner that the mix chamber has a predetermined length and size arranged for the air and the gaseous fuel being evenly mixed to form a mixture gas at the emitting end of the nozzle body;

a combustion housing mounted at the emitting end of the nozzle body to define the ignition chamber therein; and a torch head, which is provided at the emitting end of the nozzle body and supported within the combustion housing, having:

a root chamber having a size larger than the size of the emitting end of the nozzle body to form a gas stabilizing reservoir to ensure a collective and stable flow of the mixture gas, two or more elongated nozzle ducts, each having an ignition end and a root end extended to a ceiling of the root chamber, wherein the root ends of the two nozzle ducts are adjacently positioned to define a diversion joint edge therebetween while the two ignition ends of the two nozzle ducts are diverged and extended in the ignition chamber to define a torch gap therebetween, wherein the mixture gas ejected from the two ignition ends is ignited in the ignition chamber to form two torches soaring away from the two ignition ends of the two nozzle ducts, and means for forming a stable environment root flame around roots of the torches so as to hold the torches from being burst away by the escaping high-pressured mixture gas and thus gather to form a strong and stable group of torches.

DETAILED DESCRIPTION OF THE PREFERRED EMBODIMENT

Figure 1:
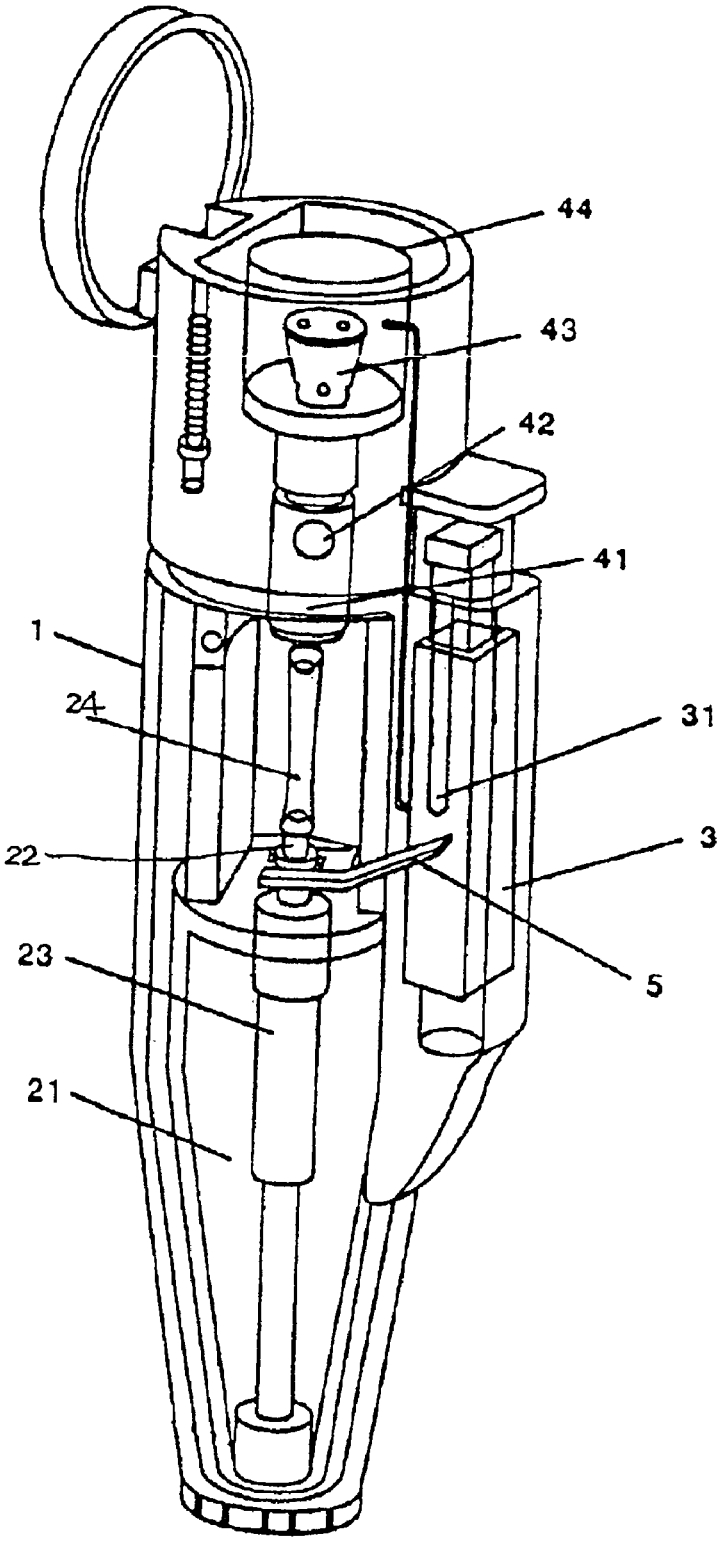
FIG. 1 is a perspective view of a torch lighter according to a preferred embodiment of the present invention.
Figure 2:
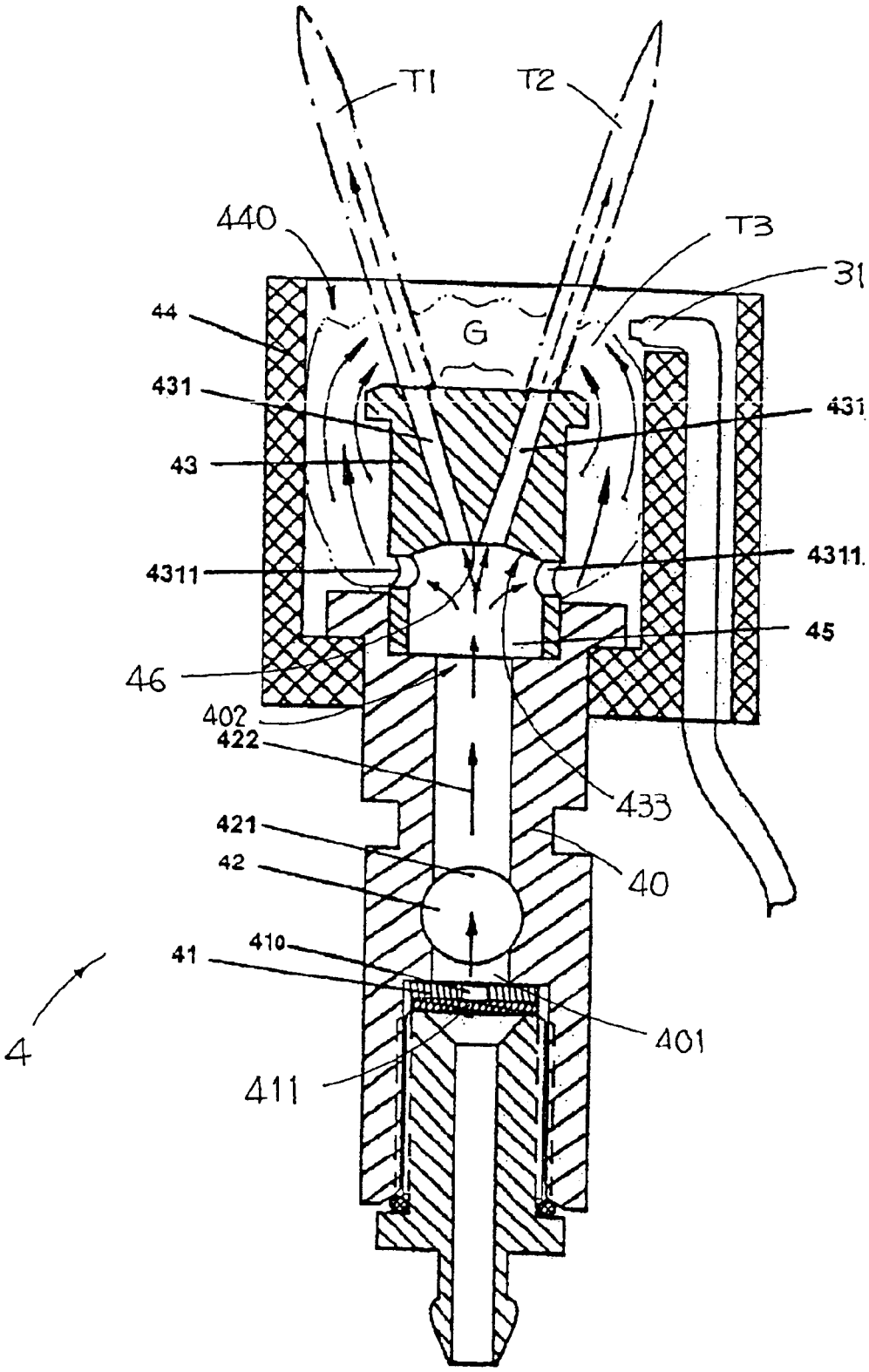
FIG. 2 is a cross-sectional view illustrating the fuel nozzle assembly according to the above preferred embodiment of the present invention.

Referring to FIGS. 1 and 2, a torch lighter according to a preferred embodiment of the present invention is illustrated, which comprises a casing 1, an ignition unit 3 and fuel nozzle assembly 4.

The casing 1 has a liquefied fuel storage 21 and a fuel valve 22 which is actuated by a fuel lever 5 pivotally mounted in the casing 5 for releasing fuel therefrom. The ignition unit 3 is arranged to generate sparks directed toward an ignition chamber 440.

The fuel nozzle assembly 4 is provided for vaporizing the fuel released from the fuel valve 22 to a high-pressured gaseous fuel to emit to the ignition chamber 440, wherein the vaporizer assembly comprises a tubular nozzle body 40, a torch nozzle 41, a torch head 43 and a combustion housing 44.

The tubular nozzle body 40 comprises a throat conduit 422 having a root opening 401 at a bottom end thereof, an emitting opening 402 at a top end thereof and at least an air inlet 421 provided thereon adjacent to the root opening 401 of the throat conduit 422 so as to define an elongated mixing chamber 42 extended between the air inlet 421 to the emitting opening 402, wherein a flow of air is capable of inletting into the mixing chamber 42 through the air inlet 421.

The torch nozzle 41 is coaxially connected between the root opening 401 of the nozzle body 40 and the fuel valve 22 via a connecting conduit 24, wherein the torch nozzle 41 has a micro nozzle pore 410 having a diameter as small as 0.05 mm to 0.12 mm, preferable 0.08 mm, wherein the fuel released from the fuel valve 22 is vaporized into a strong, pressurized gaseous fuel jetting into the mix chamber 42. The torch nozzle 41 further comprises a mesh filter 411 provided below the nozzle pore 410 to prevent any residual particles of the fuel from entering the nozzle body 40.

Accordingly, the jetting gaseous fuel provides a suction force to absorb the air into the mix chamber 42 in such a manner that the mix chamber 42 has a predetermined length and size arranged for the air and the gaseous fuel being evenly mixed to form a mixture gas at the emitting opening 402 of the nozzle body 40. Preferably, the throat conduit 422, i.e. the mix chamber 42 is an elongated straight hole having a diameter of 1 mm to 2.5 mm. Moreover, the throat conduit 422, the mix chamber 42, and the nozzle pore 410 are coaxially aligned while the air inlet 421 is a hole transversely formed on the root opening 401 of the throat conduit 422 that preferably has a diameter slightly larger than a diameter of the mix chamber 42.

It is worth to mention that, generally speaking, if the nozzle pore 410 has diameter smaller than 0.05 mm, it is very easily be blocked by dusts and particles. If the nozzle pore 410 has a diameter larger than 0.12 mm, the jetting power of the gaseous fuel is reduced for failing to produce strong torch. Similarly, if the diameter of the mix chamber 42 is smaller than 1 mm, it fails to provide any stabilizing and collecting effects for the passing gaseous fuel. If the diameter of the mix chamber 42 is larger than 2.5 mm, the jetting power of the passing gaseous fuel from nozzle pore 410 is eliminated.

By passing through the throat conduit 422, the gaseous fuel jetted from nozzle pore 410 and the inletting air from the air inlet 421 not only evenly mix to form the mixture gas but also concentrate and stabilize the flowing dynamic of the mixture gas before outputting through the emitting opening 402 of the mix chamber 42.

The combustion housing 44 is a ring shaped body having a surrounding wall defining the ignition chamber 440 therein. The emitting opening 402 of the torch nozzle 40 is extended to a bottom end of the combustion housing 44. According to the preferred embodiment, the ignition unit 3 is embodied as a piezoelectric unit having a piezoelectric tip 31 extended and secured to the surrounding wall of combustion housing 44 adapted to generate sparks towards the ignition chamber 440.

The torch head 43 is coaxially connected to the emitting opening 402 of the nozzle body 40 and supported within the combustion housing 44 in such a manner that the ignition chamber 440 is formed surrounding the torch head 43.

Preferably, a top end of the torch head 43 is lower than the top end of the combustion housing 44 and the outer diameter of the torch head 43 must be smaller than an inner diameter of the combustion housing 44, so that ignition chamber 440 is formed above and around the torch head 43.

The torch head 43 has a root chamber 45 having a size larger than the size of the emitting opening 402 of the nozzle body 40 to form a gas stabilizing reservoir to ensure a collective and stable flow of the mixture gas.

The torch head 43 further has two elongated nozzle ducts 431, each having an ignition end and a root end extended to a ceiling of the root chamber 45, wherein the root ends of the two nozzle ducts 431 are adjacently positioned to define a diversion joint edge 46 therebetween while the two ignition ends of the two nozzle ducts 431 are diverged and extended in the ignition chamber 440 to define a torch gap G therebetween.

According to the preferred embodiment, the two nozzle ducts 431 is formed in an upper solid portion of the torch head 43 by drilling two slant holes from a bottom end to a top end thereof. In other words, the two nozzle ducts 431 extended upwardly and outwardly to form a "V" shape arrangement. It is worth to mention that if the two root ends of the two nozzle ducts 431 are spaced apart more than 1.5 mm, an eddy flow may occur between the two root ends of the two nozzle ducts 431 in the root chamber 45. It would reduce the flowing speed of the mixture gas before entering the nozzle ducts 431 and thus reduce the bursting power of the torches T1, T2 to be ignited at the ignition ends of the nozzle ducts 431. In other words, the diversion joint edge 46 is preferred to have a width from zero to 1.5 mm, i.e. a distance between the two root ends of the two nozzle ducts 431, so as to evenly and smoothly diverge the mixture gas flowing through the root chamber 45 into the two nozzle ducts 431 without substantially reducing flowing speed.

In view of above, beams of mixture gas can be burst out through the two ignition ends of the nozzle ducts 431 but the sparks from the piezoelectric tip 31 substantially cannot ignite such ejecting beams of mixture gas. It is because the beams of mixture gas are burst in very high speed that it escapes into the air before the sparks ignite it.

Accordingly, the torch head 43 further comprises means for forming a stable environment root flame T3 around the torch head 43 and the emitting ends of the nozzle ducts 431 adapted for igniting the beams of mixture gas ejected from the nozzle ducts 431 to form two torches T1, T2 soaring away from the ignition ends of the nozzle ducts 431 and holding firm to the soaring torches T1, T2, as shown in FIG. 2. The means comprises a torch stabilizing arrangement 430 adapted to prevent the strong torches T1, T2 from directly bursting into the air by providing a plurality of root flames which are united and mixed with a root portion of the soaring torches to form the stable environment root flame T3 so as to hold the torches T1, T2 from being burst away by the escaping high-pressured fuel and thus gather to form a strong and stable group of torches with blue hot tip portions for better ignition effect.

According to the preferred embodiment, the diameter of each of the nozzle ducts is preferred to be 0.6 mm to 1.3 mm in order to produce strong and long torches. Moreover, the best effect will be achieved when the diversion joint edge 46 is sized as 0.8 mm for producing two or more strong, powerful and firm diverging soaring torches.

According to the preferred embodiment as shown in FIG. 2, the torch stabilizing arrangement 430 is embodied to have a plurality of diversion emitting openings 4311 formed around the torch head 43 and a conical ceiling surface 433 extended between the root ends of the nozzle ducts 413 and the diversion emitting openings 4311, wherein each of the diversion emitting openings 4311 is a through hole formed transversely at a top portion of the surrounding wall of the root chamber 45. The diversion emitting openings 4311 are preferred to be positioned right below the two root ends of the nozzle ducts 431 and evenly spaced apart at the same level.

Accordingly, since the diversion emitting openings 4311 are radially formed around the torch head 43, the main portion of the upwardly jetting mixture gas flown into the root chamber 45 will be ejected through the two nozzle ducts 431 and merely a relatively small portion of the mixture gas will be diverged to emit through the diversion emitting openings 4311 and fill up the ignition chamber 440. During the ignition operation of the torch lighter of the present invention, the sparks generated from the piezoelectric tip 31 would first ignite the mixture gas emitted through the diversion emitting openings 4311 and filled in the ignition chamber 440 to form a plurality of root flames which are united and mixed to form the environment root flame T3 surrounding the torch head 43 and the emitting ends of the nozzle ducts 431. Then, the presence of the environment root flame T3 would immediately ignite the mixture gas ejected from the two emitting ends of the two nozzle ducts 431 to produce the torches T1, T2. In fact, such a ring shaped environment root flame T3 is a preferred area for ignition.

After igniting the torch lighter, the environment root flame T3 not only holds firm to the strong torches T1, T2 to form the strong and stable group of torches but also provide a continuous flame source within the combustion housing 44. Practically, the torch lighter of the present invention is a windproof lighter that even though the torches T1, T2 are blown out in a windy surrounding, the environment root flame T3 that continuously burns inside the ignition chamber 440 will immediately ignite the ejecting mixture gas from the emitting ends of the nozzle ducts 431 to produce the torches T1, T2.

Figure 3:
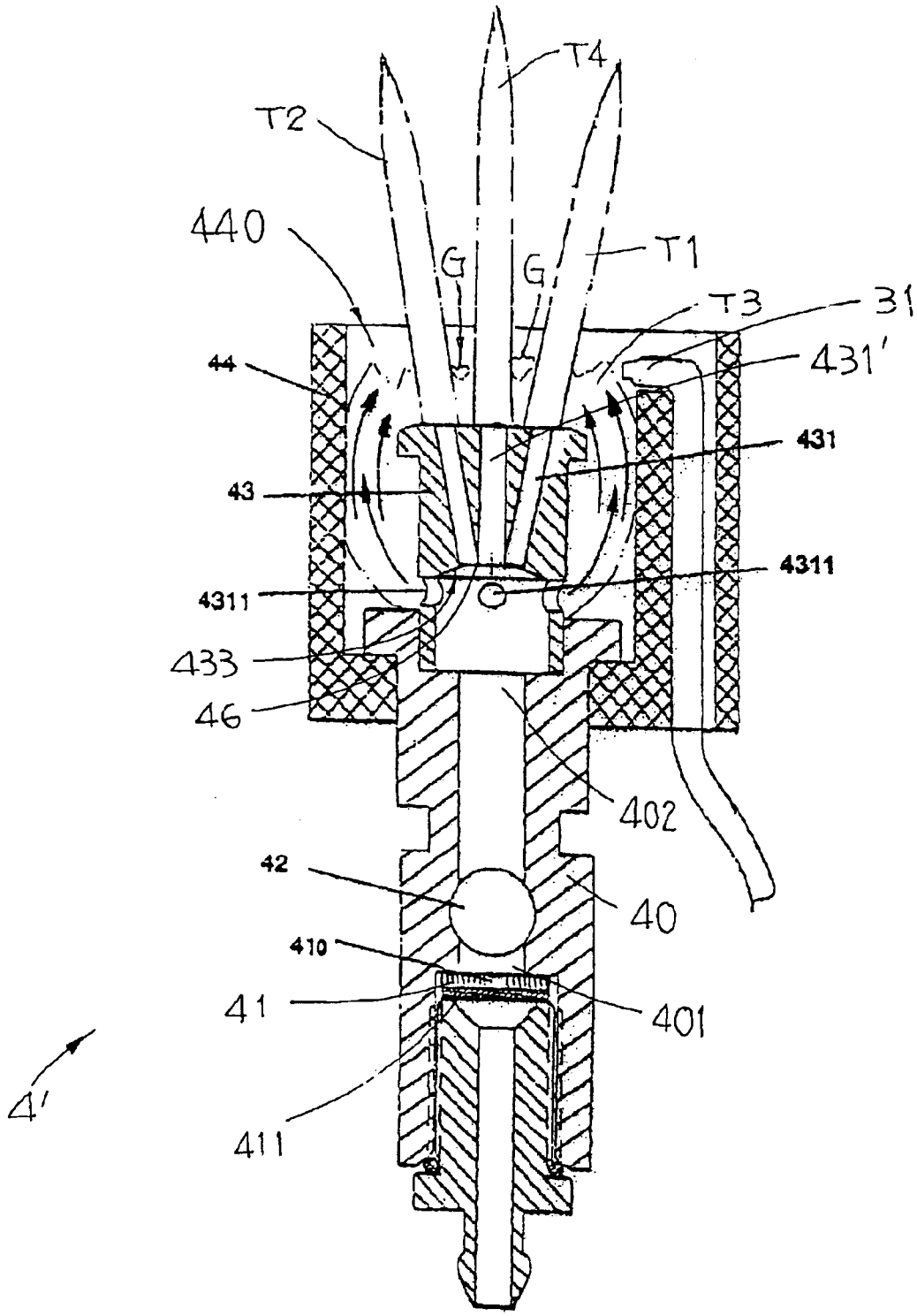
FIG. 3 is a cross-sectional view illustrating a first alternative mode of the fuel nozzle assembly according to the above preferred embodiment of the present invention.

As shown in FIG. 3, a first alternative mode of the fuel ignition assembly 4' of the torch lighter according to the above preferred embodiment of the present invention is illustrated, wherein the fuel ignition assembly 4 is structurally identical to the above preferred embodiment except three nozzle ducts 431 are presented, wherein a vertical central nozzle duct 431' is additionally provided between the two slanted nozzle ducts 431 to produce another torch T4 from an emitting end thereof. Moreover, two diversion joint edges 46, each of which is made as thin as 1.5 mm or less, are formed between the central nozzle duct 431' and the two side nozzle ducts 431. Due to the increased density of the torches, the group of torches T1, T2, T4 becomes more concentrated, stronger and hotter. Therefore, when a user is lighting a cigar, it likes to have three torch lighters generating three torches to ignite the cigar simultaneously. It is apparent that it is easier to light up the cigar promptly without the need of continuously rotating the cigar while using a conventional single torch lighter.

Figure 4:
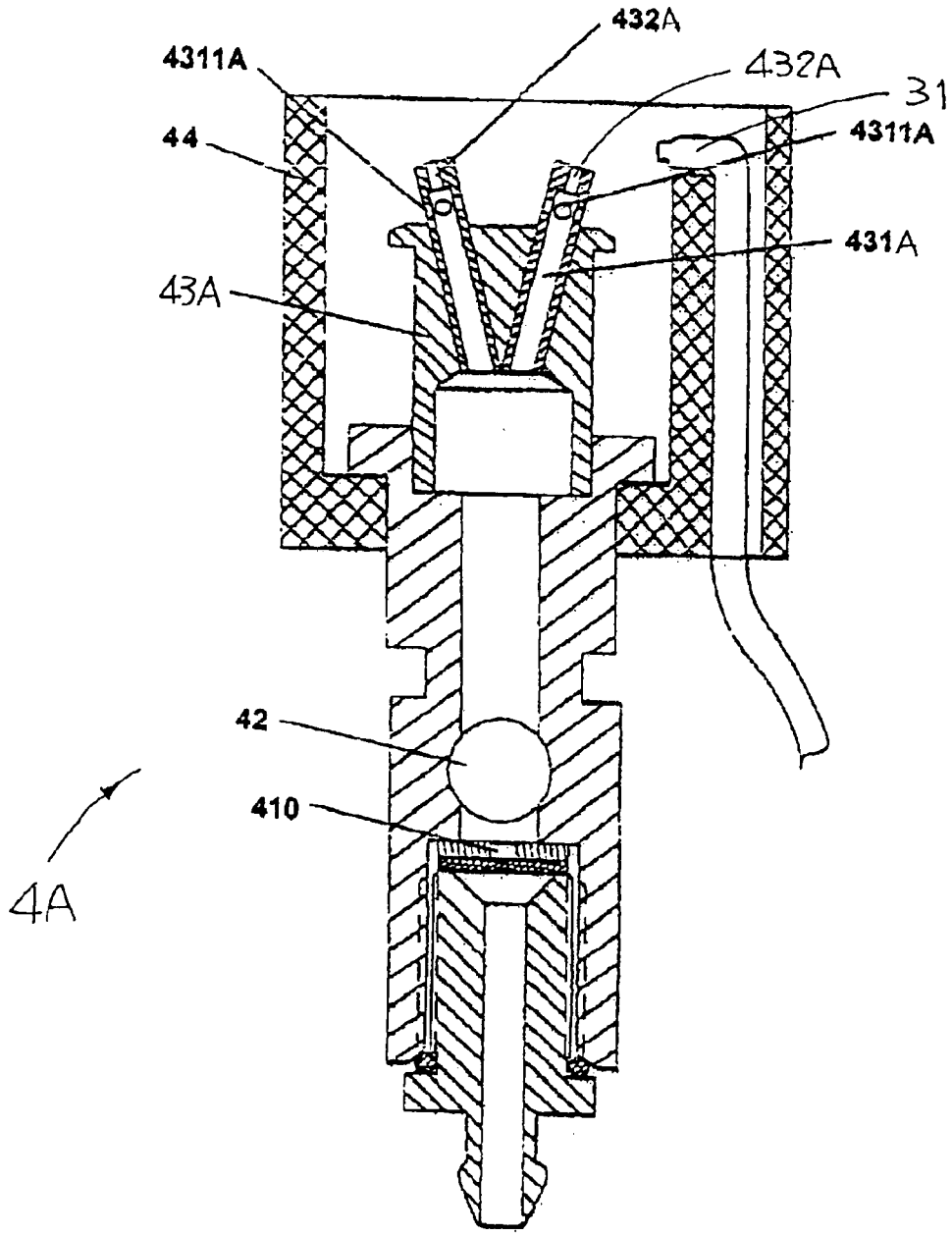
FIG. 4 is a cross-sectional view illustrating a second alternative mode of the fuel nozzle assembly according to the above preferred embodiment of the present invention.

As shown in FIG. 4, a second alternative mode of the fuel ignition assembly 4A according to the above preferred embodiment of the present invention is illustrated, wherein each of the nozzle ducts 431A is upwardly extended to have an upper portion above the torch head 43A. The diversion emitting openings 4311A are formed at the upper portions of the nozzle ducts 431A instead of around the torch head 43A, wherein in such arrangement, the emitting end 432A of each of the nozzle ducts 431A must be narrower and the rest of the nozzle duct 431A such that the ring of the environment root flame is formed around the root of the respective torch for stabilizing and holding firm to the torches produced at the emitting ends 432A of the nozzle ducts 431.

Figure 5:
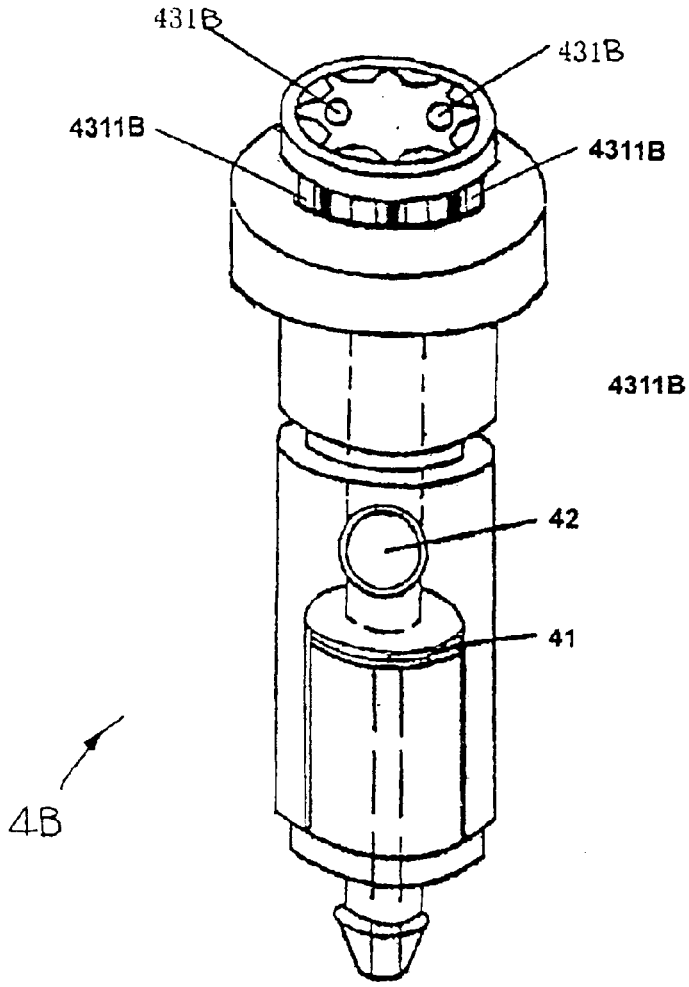
FIG. 5 is a perspective view illustrating a third alternative mode of the fuel nozzle assembly according to the above preferred embodiment of the present invention.
Figure 6:
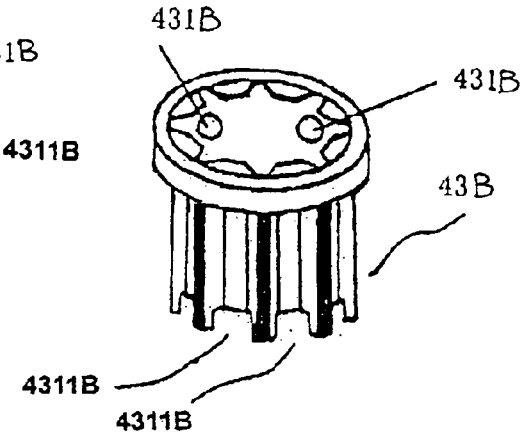
FIG. 6 is a perspective view of the torch head according to the above third alternative mode of the above preferred embodiment of the present invention.
Figure 7:
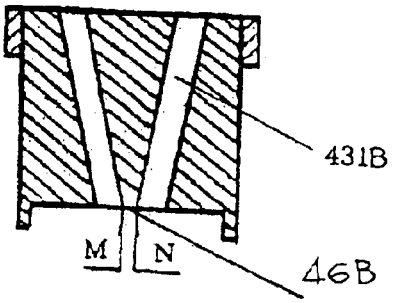
FIG. 7 is a cross-sectional view of the torch head according to the above third alternative mode of the above preferred embodiment of the present invention.

FIGS. 5 to 7 illustrate a third alternative mode of the fuel ignition assembly 4B according to the above preferred embodiment of the present invention, wherein the diversion emitting openings 4311B of the torch head 43B are vertical slots evenly spacedly formed around the torch head 43B that lead a few amount of mixture gas out in the axial direction of the exiting path of the mixture gas. Such arrangement may assure a better ring of environment root flame. As shown in FIG. 6, the torch head 43B is structured like a gear and the the bottom portion of the diversion emitting openings 4311B are now actually a layer of space defined by the top surface of the fuel ignition assembly 4B and the bottom surface of the torch head 43B. However, the layer of space functions actually as multiple diversion emitting openings 4311B extending from the root ends of the V-oriented nozzle ducts 431A. The space substitutes the diversion emitting openings 4311B and eases machining of the parts. As seen in FIG. 7, the diversion joint area 433B is about 1.5 mm or less too.

Figure 8:
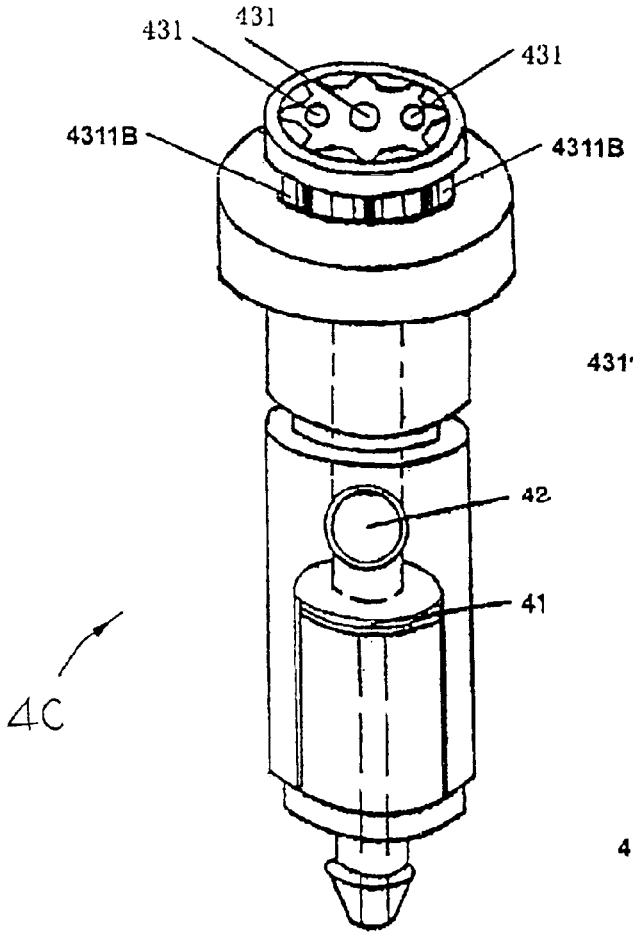
FIG. 8 is a perspective view illustrating a fourth alternative mode of the fuel nozzle assembly according to the above preferred embodiment of the present invention.
Figure 9:
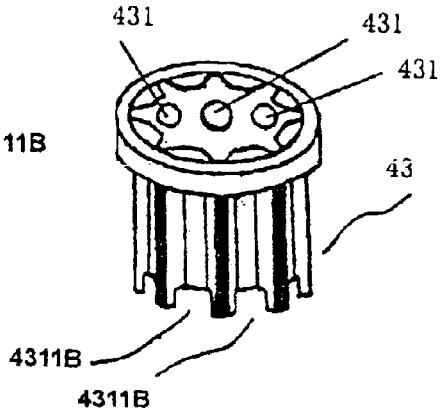
FIG. 9 is a perspective view of the torch head according to the above fourth alternative mode of the above preferred embodiment of the present invention.
Figure 10:
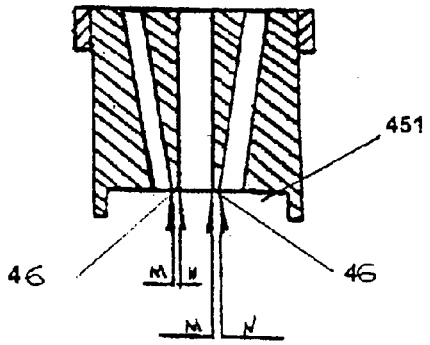
FIG. 10 is a cross-sectional view of the torch head according to the above fourth alternative mode of the above preferred embodiment of the present invention.

FIGS. 8 to 10 illustrate a fourth alternative mode of the fuel ignition assembly 4C according to the above preferred embodiment of the present invention, which is modified from the above third alternative mode to have an additional central nozzle duct between the two slanted nozzle ducts as shown in FIGS. 5 to 7.

Figure 11:
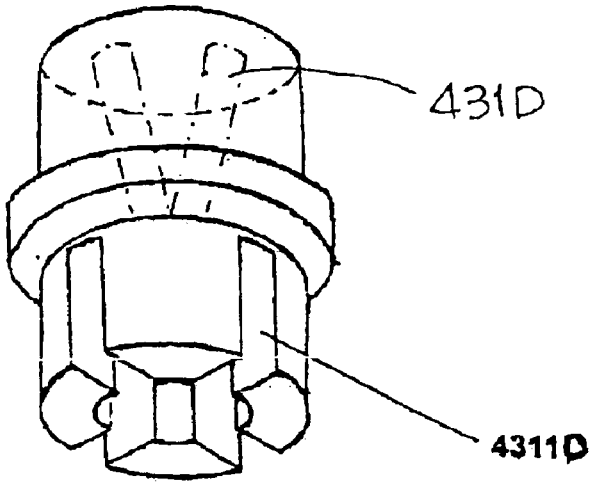
FIG. 11 is a perspective view illustrating a fifth alternative mode of the torch head according to the above preferred embodiment of the present invention.

In a fifth alternative mode of the above preferred embodiment of the present invention as shown in FIG. 11, the diversion emitting openings 4311D are not in round cross section or holes, but structured as slot form. These slot-type diversion emitting openings 4311D are provided at the bottom or base of the V-oriented nozzle ducts 431D.

Figure 12:
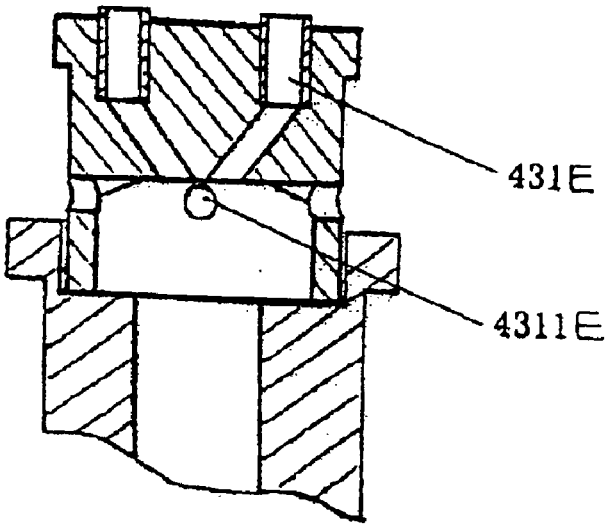
FIG. 12 is a cross-sectional view illustrating a sixth alternative mode of the torch head according to the above preferred embodiment of the present invention.
Figure 13:
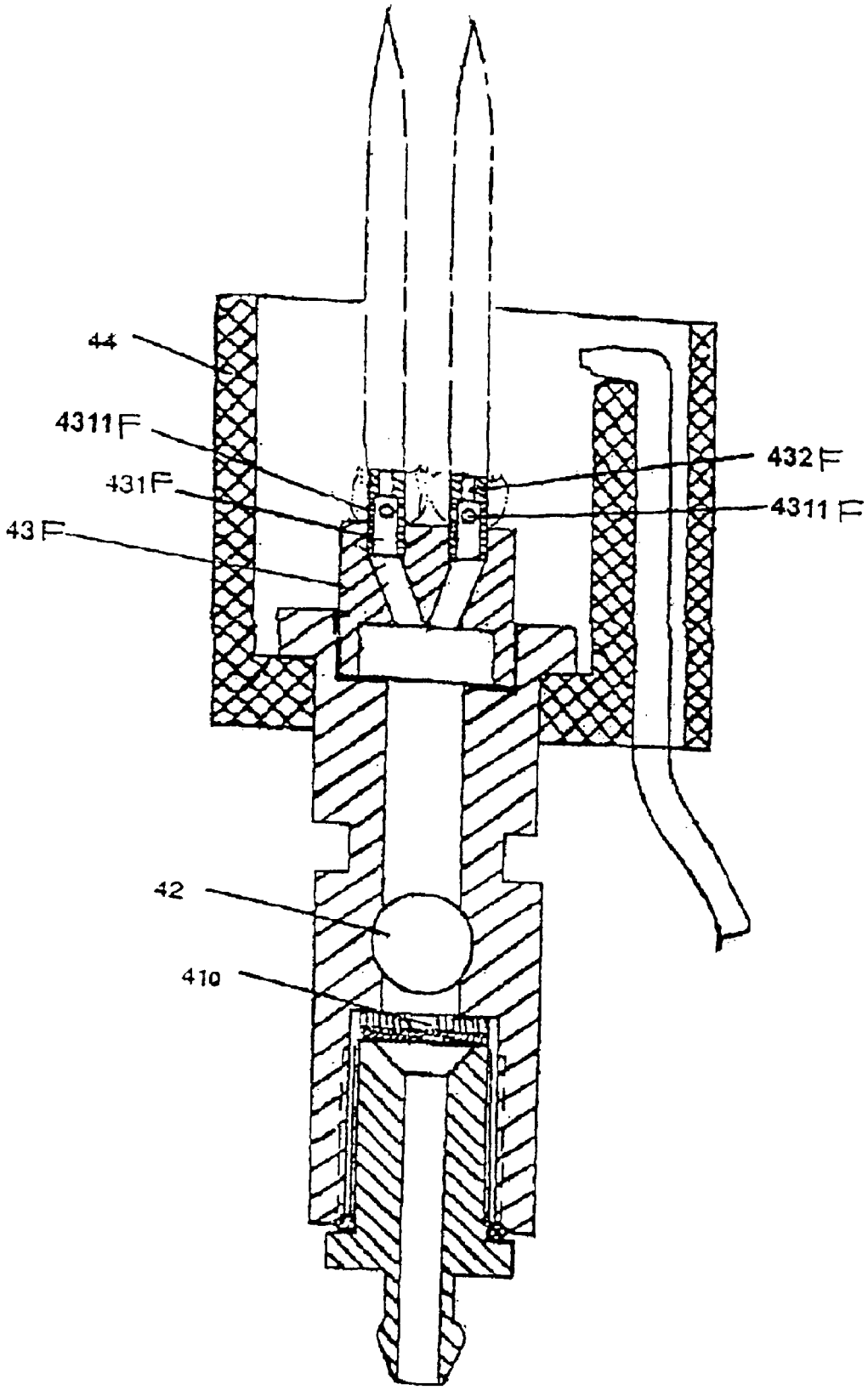
FIG. 13 is a cross-sectional view illustrating a seventh alternative mode of the fuel nozzle assembly according to the above preferred embodiment of the present invention.

FIG. 12 shows a sixth alternative mode of the preferred embodiment of the present invention which provides a straight upper portion for each of the nozzle duct 431E. The nozzle ducts 431E have a V-orientation lower portion and then have an upper part of parallel tubular duct. FIG. 13 shows seventh alternative mode of the preferred embodiment of the present invention, which is modified from the above sixth alternative mode that, like the second alternative mode as shown in FIG. 4, the diversion emitting openings 4311F are formed at the upper portions of the nozzle ducts 431F instead of around the torch head 43F, wherein in such arrangement, the emitting end 432F of each of the nozzle ducts 431F must be narrower and the rest of the nozzle duct 431F.

There could be other further variations based on the teaching of the present application. However, they will be all within the scope of the present invention as defined in the accompanying claims.

What is claimed is:

1. A torch lighter, comprising:

a casing having a liquefied fuel storage and a fuel valve which is actuated by a fuel lever pivotally mounted in said casing for releasing fuel therefrom;

an ignition unit generating sparks directed toward an ignition chamber; and a fuel nozzle assembly provided for vaporizing said fuel released from said fuel valve to a high-pressured gaseous fuel to emit to said ignition chamber, wherein said fuel nozzle assembly comprises:

a nozzle body having a root opening, an emitting opening, and at least an air inlet provided thereon, wherein said air inlet is positioned adjacent to said rooting opening to define an elongated mixing chamber axially extended between said air inlet and said emitting opening, wherein said mix chamber has a diameter sized between 1 mm to 2.5 mm and a flow of air is capable of inletting into said mixing chamber through said air inlet;

a torch nozzle, which is coaxially connected between said root opening of said nozzle body and said fuel valve, having a micro nozzle pore having a diameter of 0.05 mm to 0.12 mm and comprising a mesh filter provided below said nozzle pore for preventing residual particles of said fuel from entering said nozzle body, wherein said fuel released from said fuel valve is vaporized into a strong, pressurized gaseous fuel jetting into said mix chamber, wherein said jetting gaseous fuel and said air flowing through mix chamber are mixed to form a mixture gas at said emitting opening of said nozzle body;

a combustion housing which is supported around said emitting opening of said nozzle body and defines said ignition chamber therein; and a torch head, which is provided at said emitting opening of said nozzle body and supported within said combustion housing, having:

a root chamber, P1 at least two elongated nozzle ducts, each having an upper portion and a root end extended and opened into said root chamber, wherein said root ends of said two nozzle ducts are adjacently positioned to define a diversion joint edge therebetween while said two upper portions of said two nozzle ducts are vertically extended upwardly in a parallel manner above said torch head and define a torch gap therebetween, and a torch stabilizing arrangement has a plurality of diversion emitting openings formed at said upper portions of said nozzle ducts for providing a stable environment root flame for igniting said mixture gas ejected from said ignition ends of said nozzle ducts to form two or more spaced torches and stabilizing and holding said spaced torches to form a strong and stable group of said torches, wherein said stable environment root flame has a plurality of root flames which are united and mixed with root Portions of said spaced torches.

2. The torch lighter, as recited in claim 1, wherein said root chamber forms a gas stabilizing reservoir to ensure a stable flow of said mixture gas and said root ends of said nozzle ducts are extended to a ceiling of said root chamber.

3. The torch lighter, as recited in claim 2, wherein said two adjacent root ends of said two nozzle ducts are spaced apart for 1.5 mm or less such as said diversion joint edge has a size equal to 0 mm to 1.5 mm.

4. The torch lighter, as recited in claim 2, wherein an emitting end of each of said nozzle ducts is narrower than a rest of said nozzle duct such that said environment root flame is formed around a root of said respective torch for stabilizing and holding firm to said torches produced at said emitting ends of said nozzle ducts.

5. The torch lighter, as recited in claim 2, wherein said nozzle body is a tubular throat conduit having a root end forming said root opening, an emitting end forming said emitting opening, wherein said air inlet is transversely formed on said root end and has a diameter slightly larger than said diameter of said mix chamber so as to provide a suction force to absorb said air into said mix chamber in such a manner that said mix chamber has a predetermined length and size arranged for said air and said gaseous fuel being evenly mixed to form said mixture gas at said emitting opening of said nozzle body.

6. The torch lighter, as recited in claim 5, wherein said two adjacent root ends of said two nozzle ducts are spaced apart for 1.5 mm or less such as said diversion joint edge has a size equal to 0 mm to 1.5 mm.

7. The torch lighter, as recited in claim 6, wherein said emitting end of each of said nozzle ducts is narrower than a rest of said nozzle duct such that said environment root flame is formed around a root of said respective torch for stabilizing and holding firm to said torches produced at said emitting ends of said nozzle ducts.

8. The torch lighter, as recited in claim 6, wherein said diameter of said nozzle pore is 0.08 mm.

9. The torch lighter, as recited in claim 5, wherein said emitting end of each of said nozzle ducts is narrower than a rest of said nozzle duct such that said environment root flame is formed around a root of said respective torch for stabilizing and holding firm to said torches produced at said emitting ends of said nozzle ducts.

10. The torch lighter, as recited in claim 5, wherein said combustion housing is a ring shaped body having a surrounding wall defining said ignition chamber therein and said torch head is coaxially connected to said emitting opening of said nozzle body and supported within said combustion housing in such a manner that said ignition chamber is formed surrounding said torch head.

11. The torch lighter, as recited in claim 10, wherein a top end of said torch head is lower than a top end of said combustion housing and an outer diameter of said torch head is smaller than an inner diameter of said combustion housing, so that said ignition chamber is also formed above said torch head.

12. The torch lighter, as recited in claim 11, wherein said emitting end of each of said nozzle ducts is narrower than a rest of said nozzle duct such that said environment root flame is formed around a root of said respective torch for stabilizing and holding firm to said torches produced at said emitting ends of said nozzle ducts.

13. The torch lighter, as recited in claim 11, wherein said two adjacent root ends of said two nozzle ducts are spaced apart for 1.5 mm or less such as said diversion joint edge has a size equal to 0 mm to 1.5 mm.

14. The torch lighter, as recited in claim 13, wherein said emitting end of each of said nozzle ducts is narrower than a rest of said nozzle duct such that said environment root flame is formed around a root of said respective torch for stabilizing and holding firm to said torches produced at said emitting ends of said nozzle ducts.

15. The torch lighter, as recited in claim 13, wherein said diameter of said nozzle pore is 0.08 mm.

16. The torch lighter, as recited in claim 1, wherein said combustion housing is a ring shaped body having a surrounding wall defining said ignition chamber therein and said torch head is coaxially connected to said emitting opening of said nozzle body and supported within said combustion housing in such a manner that said ignition chamber is formed surrounding said torch head.

17. The torch lighter, as recited in claim 1, wherein said two adjacent root ends of said two nozzle ducts are spaced apart for 1.5 mm or less such as said diversion joint edge has a size equal to 0 mm to 1.5 mm.

18. The torch lighter, as recited in claim 1, wherein an emitting end of each of said nozzle ducts is narrower than a rest of said nozzle duct such that said environment root flame is formed around a root of said respective torch for stabilizing and holding firm to said torches produced at said emitting ends of said nozzle ducts.

19. The torch lighter, as recited in claim 18, wherein said diameter of said nozzle pore is 0.08 mm.

20. The torch lighter, as recited in claim 1, wherein said diameter of said nozzle pore is 0.08 mm.

* * * * *